US008627757B2

(12) United States Patent
Tobie

(10) Patent No.: US 8,627,757 B2
(45) Date of Patent: Jan. 14, 2014

(54) SYSTEM FOR PROVIDING PROTECTION AGAINST AN EXPLOSIVE THREAT

(75) Inventor: Benny Tobie, Harahava (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 338 days.

(21) Appl. No.: 12/952,049

(22) Filed: Nov. 22, 2010

(65) Prior Publication Data

US 2012/0210861 A1 Aug. 23, 2012

(30) Foreign Application Priority Data

Nov. 23, 2009 (IL) ..... 202275
Aug. 29, 2010 (IL) ..... 202275/2

(51) Int. Cl.
*F41H 5/24* (2006.01)

(52) U.S. Cl.
USPC ..... 89/36.04; 89/36.07; 89/920; 89/929; 89/937

(58) Field of Classification Search
USPC ..... 89/36.04, 36.01, 36.07, 36.08, 36.09, 89/36.11, 36.12, 920, 929, 937; 293/124; 296/187.07, 187.08
See application file for complete search history.

(56) References Cited

U.S. PATENT DOCUMENTS 1,301,880 A * 4/1919 Sills ..... 293/124
1,346,850 A * 7/1920 Sills ..... 293/124
1,465,589 A * 8/1923 Rodgers ..... 293/124
4,326,445 A 4/1982 Bemiss
5,663,520 A 9/1997 Ladika et al.
6,658,984 B2 12/2003 Zonak
6,931,977 B2 * 8/2005 Rothenbuhler ..... 89/36.01
7,228,927 B2 6/2007 Hass et al.
7,357,062 B2 4/2008 Joynt
7,540,229 B2 6/2009 Seo et al.
2004/0211311 A1 * 10/2004 Rothenbuhler ..... 89/36.07
2005/0257679 A1 11/2005 Hass et al.

(Continued)

FOREIGN PATENT DOCUMENTS

AU 703896 4/1999
EP 1574812 9/2005

(Continued)

OTHER PUBLICATIONS

A Primer in MRAP Variants, Oct. 23, 2007, Defensetech.org, 4 pages.

(Continued)

*Primary Examiner* — Jonathan C Weber
(74) *Attorney, Agent, or Firm* — Dorsey & Whitney LLP

(57) ABSTRACT

A system for use in a construction including a compartment to be protected from an explosive threat incoming from an expected threat direction. The construction comprises a surface disposed in front of the compartment and having at least a section thereof expected to be impacted by the explosive threat, and a component disposed between the surface and the compartment. The system comprises two cables, and an elongated element having two end portions and a bendable portion and being configured for mounting in the construction so that at least a part of the bendable portion is disposed between the section and the compartment and flexible towards the compartment to be protected, upon application thereto of a force caused by the explosive threat. Each cable is connectable at one end thereof to the component, and at the other end thereof is connected to one of the ends of the elongated element.

20 Claims, 12 Drawing Sheets

(56) References Cited

U.S. PATENT DOCUMENTS

| | | | |
|---|---|---|---|
| 2007/0084337 | A1 | 4/2007 | Strassgurtl et al. |
| 2007/0186762 | A1 | 8/2007 | Dehart et al. |
| 2007/0234896 | A1 | 10/2007 | Joynt |

FOREIGN PATENT DOCUMENTS

| | | |
|---|---|---|
| GB | 2466906 | 7/2010 |
| WO | WO0239048 | 5/2002 |
| WO | WO03102489 | 12/2003 |
| WO | WO2008127272 | 10/2008 |

OTHER PUBLICATIONS

Vehicles: armoured, Kemp, Ian; Biass, Eric H., Armada International, Jun. 1, 2008, 15 pages.
Mine Protected Vehicle, 2009, 4 pages.
Sandcat, Protected Multi-Role Vehicle, Oshkoshdefense.com, 2009, 6 pages.

* cited by examiner

SYSTEM FOR PROVIDING PROTECTION AGAINST AN EXPLOSIVE THREAT

FIELD

A system for protecting a compartment of a construction from an explosive threat.

BACKGROUND

It is known that if a construction is subjected to sudden external forces, such as those caused when an outer surface of the construction is impacted by an explosion, damage to objects and injury to occupants within the construction can likely occur.

A common explosive threat used against a vehicle, such as an armored personnel carrier having a lower hull, is a mine planted on a ground surface, above which the vehicle is likely to pass. When the vehicle passes over the mine, the mine detonates causing extremely high forces and shrapnel to be projected on the lower hull of the vehicle. The forces applied on the lower hull can cause at least a part of it which is closest to the source of the explosion to be violently projected in a direction towards a compartment in the vehicle, for example towards a passenger compartment containing passengers. Motion of the lower hull can cause it to impact vehicle components intermediate the lower hull and the compartment, such as the gearbox, drivetrain or even a floor of the compartment, which in turn are caused to enter the compartment at speeds which can injure or kill passengers within the compartment and damage objects therein.

Descriptions of vehicles designed in various ways to attempt to withstand explosive threats can be found in the following publications: US 2007/0234896, WO 2008/127272, U.S. Pat. No. 7,357,062, WO 03/102489, AU 703896, WO 02/39048, U.S. Pat. No. 5,663,520, US 2007/0186762, US 2007/0084337, U.S. Pat. No. 6,658,984 and US 2005/0257679.

SUMMARY

For the purposes of the specification and the claims that the terms below are defined as follows:

- "vehicle" is intended to include all types of transportation such as land, sea and air vehicles;
- "compartment" is a volume defined within, but not inclusive of, surrounding surfaces, for example a passenger compartment of a vehicle is defined as a volume within a floor, roof and side walls of the vehicle, however the floor, roof and side walls themselves are not considered the compartment.
- "cable" is intended to include all types of suitable non-rigid elements (i.e. which do not transfer compression forces) and which are sufficiently strong to withstand tensile forces of the type incurred in an explosive event; cables can be made of to textile materials or materials having similar properties thereto, non-limiting examples are steel or fiber ropes, and straps;
- "connection element" is an element that allows connection thereto of a cable in a static or dynamic manner;
- "static manner" in the connection of elements means that portions of such elements which are connected in such manner are incapable of undergoing translational motion with respect to each other; for example an end portion of a cable which is tied or welded to a bracket is connected thereto in a static manner;

- "dynamic manner" in the connection of elements means that portions of such elements which are connected in such manner are capable of undergoing translational motion with respect to each other; for example an intermediary or non-end portion of a cable which engages a pulley, can move with respect to the pulley, when sufficient force is applied to the intermediary or non-end portion of the cable to cause translational motion of the cable, and no corresponding force is applied to the pulley to cause it to move together with the cable.

According to a first aspect of the subject matter of the present application, there is provided a system for use in a construction comprising a compartment to be protected from an explosive threat incoming from an expected threat direction, a surface disposed in front of the compartment relative to the threat direction and having at least a section thereof expected to be impacted by the explosive threat, and a component disposed between the surface and the compartment; the system comprising an elongated element and two cables; the elongated element having two end portions and a bendable portion and being configured for mounting in said construction so that at least a part of said bendable portion is disposed between said section and said compartment and is configured to flex towards the compartment to be protected, upon application thereto of a force caused by the explosive threat, each cable being connectable at one end thereof to the component, and at the other end thereof being connected to one of the ends of the elongated element so that flexing of the bendable portion towards the component causes pulling of the cables by the ends of the elongated element away from the component, thereby restricting the movement of the component towards the compartment to be protected.

The elongated element can be a cable. In such case the elongated element and to the two cables can together constitute portions of a single continuous cable.

The elongated element can be a beam. The beam can be a beam of a vehicle.

The construction can be a vehicle. In such case the surface of the construction can be an outer surface of a vehicle. The surface can be an outer surface of a wall of a vehicle. The surface can be an outer surface of a belly of a vehicle. The surface of the construction can be integrally formed with the elongated element such that a surface of the elongated element constitutes an outer surface of the construction.

The construction can comprise anchoring elements. The anchoring elements can be secured to the construction.

The two ends of the elongated element can be configured to engage two anchoring elements of the construction at engagement points. Each of the engagement points can intersect an imaginary plane oriented perpendicular to the expected threat direction. Each of the engagement points can be spaced a magnitude of distance corresponding to a magnitude of width of the compartment to be protected. Such magnitude of width being measured along an axis oriented perpendicular to the expected threat direction.

The cables can be configured to be connectable to the component at connection points thereon which are disposed closer to the compartment than the section of the surface to the compartment to be protected. The cables can be configured to be connectable to the component at connection points thereon which are disposed closer to the section of the surface to the compartment to be protected than the compartment.

The system can comprise connection elements. The connection elements can engage the component, elongated element or construction to allow the cables connected thereto to be held in a predetermined spatial disposition. Non-limiting examples of connection elements can be brackets, eyelets, apertures, carabiners or pulleys.

The system can further comprise at least one elongated bracket having first and second ends spaced from each other; the first end of the at least one elongated bracket being configured to be mounted on the component; at least one of the two cables being configured to be connectable to the component via connection with the second end of the at least one elongated bracket. The brackets can be used when at least one additional component obstructs an imaginary straight path between the first end of the bracket and one of the ends of the elongated element.

The two end portions of the elongated element can be configured to move in a direction away from the compartment to be protected, upon the application to the elongated element of the force caused by the explosive threat. Such movement can be configured by engagement of the two end portions with vertical walls of the construction.

The bendable portion can be disposed adjacent to the section. It will be understood that while the bendable portion is disposed adjacent to the section the two end portions are spaced therefrom. In other words the bendable portion is closer to the section than the two end portions.

The two cables can be configured to be connected to the component in a normally taut state. If the elongated element is a cable, it can be configured to be connected to the two cables in a normally taut state.

It will be understood that the term "taut" does not mean the cable is required to be highly tensed, but only that the cable is not slack.

The term "normally" is meant to exclude abnormal situations such as when the cables are impacted by explosive forces.

The two cables can be configured to be connected to points on the component such that the portions of the cables adjacent to the elongated element each form an acute angle with the bendable portion thereof. The two cables can be configured to be connected to points on the component such that the portions of the cables adjacent and extending from the ends of the elongated element each form an acute angle with an imaginary plane oriented perpendicular to the expected threat direction.

The construction can be a vehicle. In such case the component can be any one of the vehicle's chassis, gearbox, drivetrain, and floor of the vehicle's passenger compartment.

The vehicle can have a V-shaped or parabola-shaped lower hull.

The construction can further comprise at least one additional system. The system can have any of the features mentioned hereinabove or below.

The compartment can be an occupant compartment of a vehicle. The occupant compartment can be a passenger compartment or a driver compartment of a vehicle.

The component can be a cable. In such case the cable can be connected to side walls of the vehicle. The cable can extend horizontally. The cable can be a central portion of a cable, the outer portions of which are the two cables of the system.

The expected threat direction can be any direction which the surface faces.

For example, when the expected threat is a mine intended for impacting a lower portion of a vehicle, the expected direction can be an upward direction.

The component can have a first dimension of length and a second dimension of length smaller than, and transverse to, the first dimension. The first dimension can be the largest length of the component along an imaginary axis extending through the component from the section of the surface to the compartment to be protected. The ends of the cables can be configured to be connectable to the component at connection points which are each adjacent to axis points of the imaginary axis that are spaced from each other, so that the pulling of the cables causes rotation of the component.

The component can be configured to deform upon application of a tensile force thereon which is of a magnitude less than a magnitude of tensile force which the cable or cables are configured to withstand.

Possible advantages of using cables in the system described above can be that:

- when used in a vehicle, undesired compressive forces are not transferred to the component via the cables during motion of the vehicle along a rough surface; and
- the system is extremely light due to the capability of the cables to have a high tensile force per area ratio (for example 150 kg/mm$^2$ or 250 kg/mm$^2$), when compared with tensile force per area ratio of rigid elements.

Another possible advantage of the system described above can be that:

- when the component or elements holding the component are deformed due to pulling of the cables during an explosion, the deformation absorbs some of the energy of the explosion.

In addition to any of the features described above, the system can comprise at least one additional cable for restricting upward motion of the component.

The at least one additional cable can engage an upper portion of the component.

The at least one additional cable can be connected at each end thereof to opposing ends of the component. In a case where the component is a chassis, the at least one additional cable can be connected between two longitudinal beams of the chassis.

The at least one additional cable can be two cables, each connected at a first end thereof to one of the ends of the elongated element, and at a second end thereof to an one side of the component. Each cable can have an intermediary portion which engages an upper part of the component disposed between the one side of the component and the end of the elongated element to which the first and second ends of the cable are connected.

The at least one additional cable can be a plurality of cables which together form a net configuration.

The at least one additional cable can be a plurality of cables which together creates a net configuration.

In addition to any of the features described above, the component can be strengthened along a horizontal plane between upper sections thereof, such that it is stronger along that plane than a horizontal plane disposed thereunder to which the cables are connected thereto.

The component can be reinforced at an upper section thereof in comparison to a lower section thereof to which the cables are connected.

For example, the system can comprise a reinforcement element joining longitudinal beams of a chassis (when the component is a chassis). The reinforcement element can be a cable. The reinforcement element can be constituted by the at least one additional cable. The reinforcement element can be a transverse beam of greater thickness (and/or made of stronger material) than lower transverse beams of the chassis.

The component can be a cable.

The component can be an intermediary portion of a cable, the cable including the two cables, each of which constitute a portion of the cable extending from alternative sides of the intermediary portion.

The construction can comprise a plurality of systems. In such case there can be at least one reinforcement element connected between adjacent systems for providing reinforcement thereto. The at least one reinforcement element can extend along a longitudinal direction of the construction. The at least one reinforcement element can be connected to elongated elements of the systems.

The system having any of the features above can be part of an assembly comprising at least two such systems.

The assembly can comprise at least one reinforcement element connected between the at least two systems for providing reinforcement thereto.

According to a further aspect of the subject matter of the present application, there is provided an assembly comprising a system.

The system can have any of the features mentioned above in connection with the first aspect.

According to a yet another aspect of the subject matter of the present application, there is provided a construction comprising a system.

The system can have any of the features mentioned above in connection with the first aspect.

BRIEF DESCRIPTION OF THE DRAWINGS

In order to understand the subject matter of the present application and to see how it can be carried out in practice, embodiments will now be described, by way of non-limiting example only, with reference to the accompanying drawings, in which.

DETAILED DESCRIPTION OF EMBODIMENTS

Figure 1A:
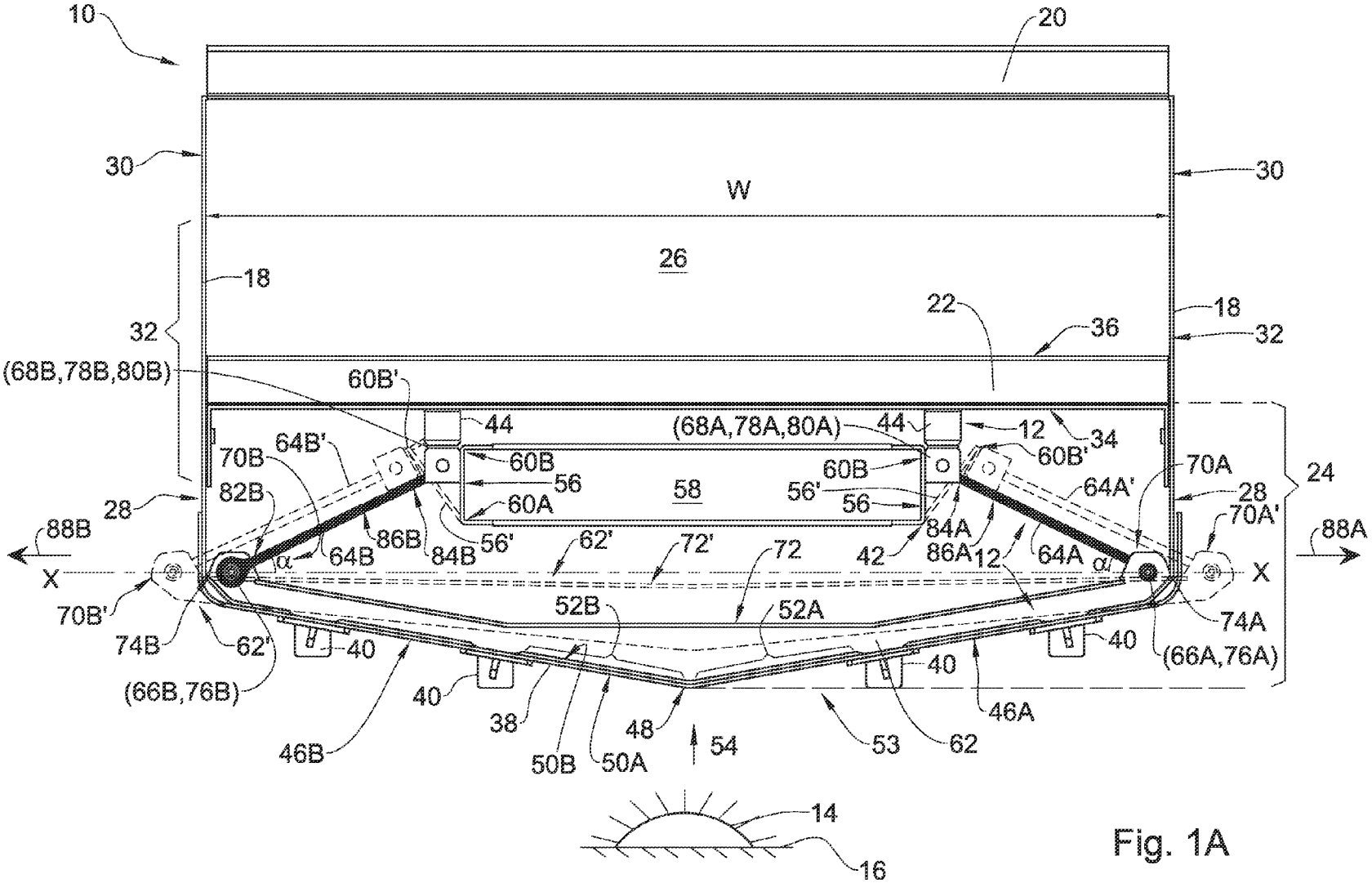
FIG. 1A is schematic front view of a portion of a vehicle with multiple systems therein for providing protection against an explosive threat, one of the systems being shown in a first position, and a second position, illustrated in phantom, caused by an explosion.
Figure 1B:
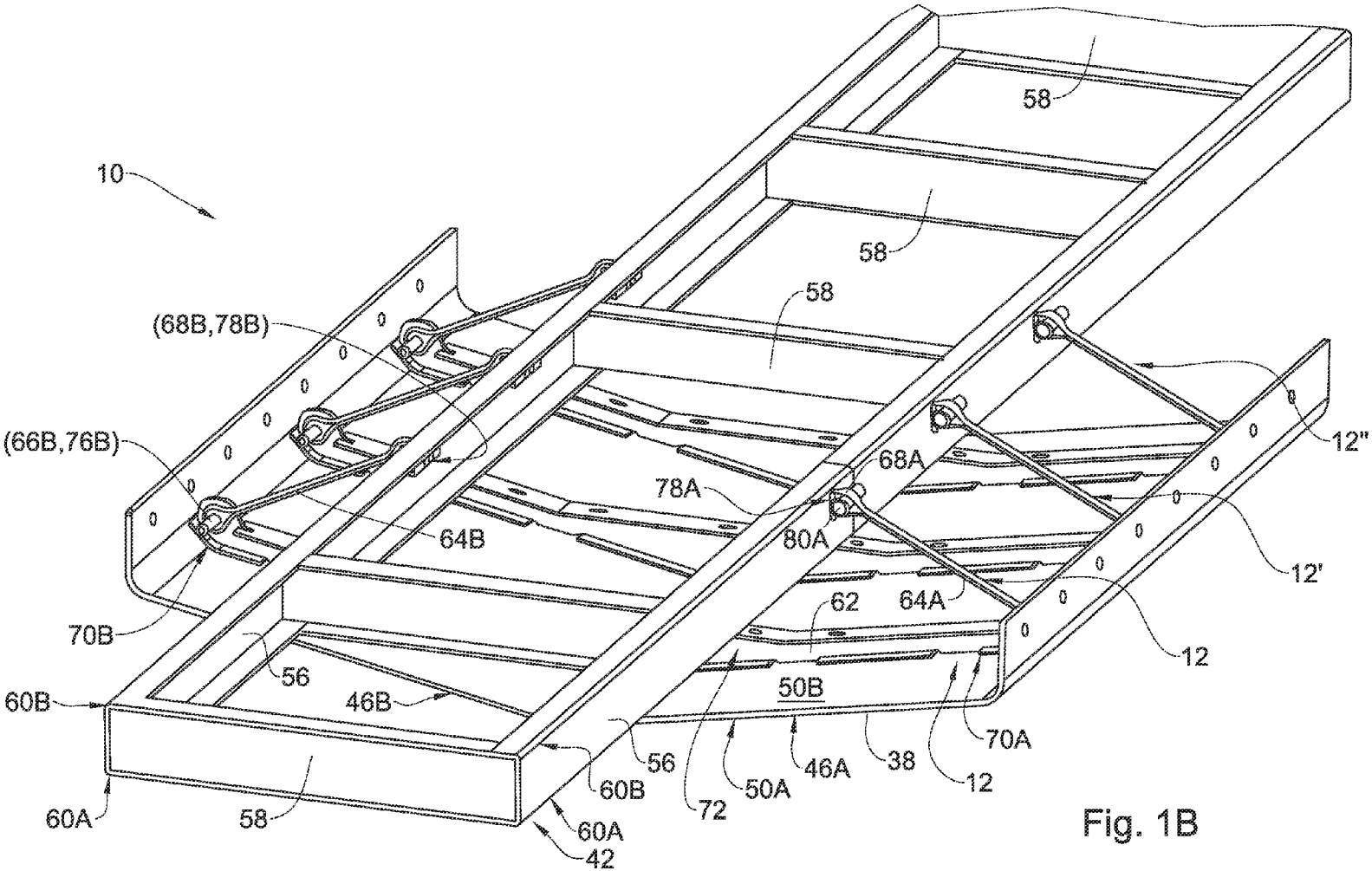
FIG. 1B is a schematic perspective view of the vehicle and systems in FIG. 1A, in the first position, excluding the vehicle's side walls, roof, floor and bumpers.

Referring now to the drawings wherein like reference characters designate like or corresponding parts throughout several views, with reference to FIGS. 1A and 1B, there is illustrated selected elements of a vehicle generally designated by the numeral 10, which in this example as an armored personnel carrier, and a system, generally designated as 12, disposed within the vehicle 10 for providing protection against an explosive threat 14 (FIG. 1A) disposed on the ground 16 under the vehicle.

The vehicle 10 comprises side walls 18, a roof 20, a floor 22 and a lower hull generally designated as 24.

Within the side walls 18, roof 20 and floor 22, together with front and back walls (not shown), there is defined a passenger compartment generally designated as 26.

The side walls 18 each have lower and upper ends (28, 30), and an intermediate portion 32 extending therebetween.

The floor 22 extends between the intermediate portions 32 of the side walls. The floor 22 comprises a lower surface 34 and an upper surface 36.

The lower hull 24 comprises a V-shaped belly 38 disposed adjacent to the ground 16 upon which the vehicle 10 rests, fastening elements 40, a chassis, generally designated as 42, and disposed between the belly 38 and the floor 22, and bumpers 44 disposed between and engaging the chassis 42 and the floor 22.

The V-shaped belly 38 comprises first and second slanted parts (46A, 46B) meeting at a lowest point 48 of the belly 38, and lower and upper surfaces (50A, 50B). The upper surface 50B of the belly 38 is closer to the floor 22 than the lower surface 50A thereof. The lowest point 48 of the belly 38 and adjacent portions (52A, 52B) of the first and second slanted parts together constitute a section 53 of the belly expected to be impacted by the explosive threat 14 in a direction (shown by arrow 54) towards the passenger compartment 26.

It will be understood that in a real event, a mine can be detonated under any part of a vehicle, however, in this example, the lowest part of a vehicle, which in the present example is section 53 of the lower surface 50A, will be most significantly impacted by such detonation. Therefore the system 12, in this example, is designed for an explosion under the most susceptible area to damage, i.e. section 53, in a direction towards the passenger compartment 26.

The chassis 42 comprises longitudinal side beams 56 and transverse beams 58 extending therebetween, and lower and upper corners (60A, 60B).

The system 12 comprises an elongated element 62, two cables (64A, 64B), and connection elements (66A, 66B, 68A, 68B) for connection of the elongated element 62, two cables (64A, 64B) and chassis 42.

The elongated element 62 is a V-shaped beam comprising two end portions (70A, 70B) and bendable portion 72. The bendable portion 72 is disposed adjacent to the section 53 of the surface and is configured to flex towards the passenger compartment 26 upon application thereto of a force caused by the explosive threat 14. Notably, the bendable portion 72 is adjacent the belly 38 and spaced from the chassis 42.

In the present example, the elongated element 62 is secured to the belly 38 via the fastening elements 40. However, it will be understood that an elongated element (not shown) could be integrally formed with a belly, and a surface of the elongated element facing an explosive threat would then be constituted by the surface of the belly facing the threat.

The two end portions (70A, 70B) of the elongated element 62 are configured to engage two anchoring elements constituted in this example by the lower ends 28 of the side walls 18 of the vehicle 10. The engagement of the anchoring elements 28 with the elongated element 62 is at engagement points (74A, 74B) which intersect an imaginary plane X oriented perpendicular to the expected threat direction 54. The engagement points (74A, 74B) are spaced from each other a magnitude of distance W corresponding to a magnitude of width of the compartment 26 to be protected, such width being measured in a direction perpendicular to the expected threat direction 54.

Each of the connection elements (66A, 66B) associated with the elongated element 62 comprises an aperture (not seen) formed in one of the two end portions (70A, 70B), and an associated bolt (76A, 76B) configured to secure one of the cables (64A, 64B) to the aperture. The bolts (76A, 76B), when secured to the aperture, extend in a direction parallel to the longitudinal side beams 56.

Each of the connection elements (66A, 66B) associated with the chassis 42, include a metal bracket (78A, 78B) mounted on the chassis 42 adjacent one of the upper corners 60B and a bolt (80A, 80B). Each bracket (78A, 78B) is formed with an aperture (not seen) and an associated bolt (80A, 80B) is configured to secure one of the cables (64A, 64B) to the aperture. The bolts (80A, 80B), when secured to the aperture, extend in a direction parallel to the longitudinal side beams 56.

Each of the cables (64A, 64B) has a 14 mm diameter and is configured to withstand tensile forces of up to 150 kilograms per square millimeter. The cable in the present example is sold under the trade name. Each cable (64A, 64B) has first and second ends (82A, 82B, 84A, 84B) and an intermediate portion therebetween (86A, 86B). In this example, each cable (64A, 64B) is doubled up (i.e. having two sections of the intermediate portion (86A, 86B) extending alongside itself) and each of the two ends thereof (82A, 82B, 84A, 84B) is in the shape of a loop. The loops are configured to allow insertion of one of the bolts (76A, 76B, 80A, 80B) therethrough.

Each cable (64A, 64B) is connected at one end thereof (84A, 84B) to a bracket (80A, 80B) on the chassis 42, and at the other end thereof (82A, 82B) is connected to one of the ends (70A, 70B) of the elongated element 62 via the connection element (66A, 66B) thereof. The bolts (76A, 76B, 80A, 80B) securing the ends (82A, 82B, 84A, 84B) to the elongated element 62 and chassis 42, in a static manner.

The cables (64A, 64B) are held in a taut state between the chassis 42 and the elongated element 62.

An angle $\alpha$ is formed between at least a portion of each cable (64A, 64B), which in this example is the entirety of each cable as they are linear, each portion extending from each first end (82A, 82B) which is connected to an end of the elongated element (82A, 82B), and the imaginary plane X oriented perpendicular to the expected threat direction. In this example the angle is 25.6 degrees.

Operation

With reference only to FIG. 1A, initial motion of the system 12 during impact of explosive forces on the vehicle 10 caused by the explosive threat 14, will now be described.

Elements of the system 12 in their first position, i.e. before the vehicle is impacted by explosive forces, are identified in accordance with the numerals designated above. Elements of the system 12 in their second position, i.e. after the initial motion thereof caused by explosive forces, are identified in accordance with the numerals designated above, with the addition of an apostrophe.

It will be understood that the motion of the elements of the system 12 in their second position can be exaggerated for illustrative purposes, and that the motion thereof can be smaller in reality.

Upon detonation of the explosive threat 14, the section 53 of the lower surface 50A is thrust upward by explosive forces (not shown) in the expected threat direction 54. The section 53 transfers compressive forces to the elongated element 72 in the expected threat direction 54, however these forces are countered by forces in a direction opposite to the expected threat direction 54 by the engagement of the two end portions (70A, 70B) of the elongated element 62 with the lower ends 28 of the side walls 18 of the vehicle 10. Such counterforce being caused by the weight of the side walls and other elements of the vehicle connected thereto. While motion of the two end portions (70A, 70B) is restricted along the expected threat direction 54, they are able to move sideways, in a direction parallel with plane X. The bendable portion 72' is moved towards the passenger compartment 26, and consequently the two end portions (70A', 70B') are moved sideways, in a direction outward from the vehicle (88A, 88B). Notably, since the bendable portion 72' is spaced from the chassis 42, the motion of the bendable portion 72' does not directly impact the chassis 42 and push it into the passenger compartment 26.

The upward flexing of the bendable portion 72' towards the chassis 42, and the sideways motion of the two end portions (70A', 70B') causes pulling of the cables (64A', 64B') by the ends (70A', 70B') of the elongated element 62' away from the chassis 42, and away from the passenger compartment 26.

The pulling on the cables (64A', 64B') applies tensile forces on the longitudinal side beams 56' causing the upper corners thereof 60B' to be ripped from the transverse beams 58 in an outward and downwards motion. This motion is in a direction away from the passenger compartment 26, further restricting motion of the chassis 42 theretowards.

It will be understood that the ripping of the longitudinal side beams 56' from the transverse beams 58 causes deformation which serves to absorb part of the explosive forces impacting the vehicle 10.

The system 12 thereby reduces or prevents motion of the chassis 42 into the passenger compartment 26, thereby protecting any occupants or objects disposed therein.

With reference to FIG. 1B, it can be seen that more than one system (12, 12', 12") can be used with a single construction.

Figure 2:
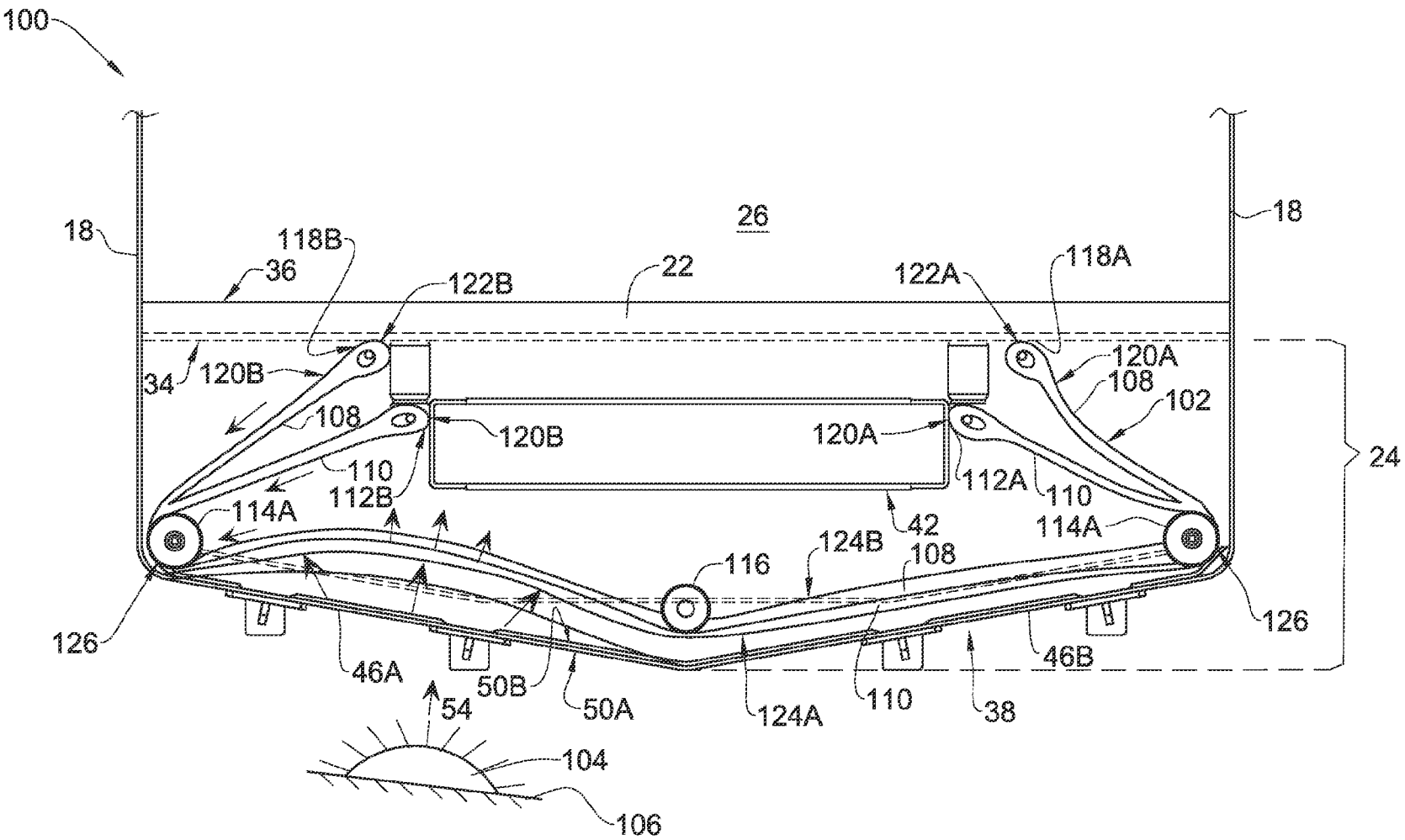
FIG. 2 is a schematic front view of a portion of a vehicle with another system therein for providing protection against an explosive threat, the system being illustrated in a position caused by an explosion.

Turning attention now to FIG. 2, there is illustrated selected elements of a vehicle generally designated by the numeral 100, and a system, generally designated as 102, disposed within the vehicle 100 for providing protection against an explosive threat 104 (FIG. 1A) disposed on the ground 106 under the vehicle.

The vehicle 100 comprises the same elements as those described above with respect to FIGS. 1A and 1B.

The system 102 comprises two elongated elements (108, 110), and connection elements (112A, 112B, 114A, 114B, 116, 118A, 118B) for connection of the elongated elements (108, 110), chassis 42 and floor 22.

Each elongated element (108, 110) is a continuous cable of the same type as the cables (64A, 64B) described above with reference to FIGS. 1A and 1B, and is held in a taut state. Each elongated element (108, 110) has first and second ends (120A, 120B, 122A, 122B) and a bendable portion (124A, 124B) extending therebetween. In this example, each of the ends (120A, 120B, 122A, 122B) is in the shape of a loop. The loops being configured for connection to connection elements (112A, 112B, 118A, 118B) in the same manner as that described above with reference to FIGS. 1A and 1B.

The connection elements (112A, 112B) on the chassis 42, and the connection elements (118A, 118B) on the lower surface 34 of the floor 22 are of the same type as the connection elements (66A, 66B) described above with reference to FIGS. 1A and 1B.

The connection elements (114A, 114B, 116) are pulleys fixed to the upper surfaces 50B of the V-shaped belly 38.

The ends 122A, 122B of the elongated element 108 are connected in a static manner to the connection elements (118A, 118B) on the floor 22.

The ends 120A, 120B of the elongated element 110 are connected in a static manner to the connection elements (112A, 112B) on the chassis 42.

The bendable portions (124A, 124B) each normally engage the upper surface 50B of the belly 38, and the pulleys (114A, 114B, 116) in a dynamic manner. In FIG. 2, the normal engagement of the bendable portions (124A, 124B) with the belly 38 is shown only along the second slanted part 46B and not along the first slanted part 46A.

This is because the bendable portions (124A, 124B) that were adjacent the first slanted part 46A have been moved in an upward direction 54, by explosive forces on the vehicle 100 caused by the explosive threat 104, disposed under the first slanted part 46A.

In this example upon detonation of the explosive threat 104, the first slanted part 46A is thrust upward by explosive forces (not shown) in the expected threat direction 54. The upward forces applied to the bendable portions (124A, 124B) are countered by forces in a direction opposite thereto by the engagement of the bendable portions (124A, 124B) with the pulleys (114B, 116). The pulleys (114B, 116) are held in place via their connection with the vehicle 100. While motion of parts 126 of the bendable portions (124A, 124B) engaging the pulleys (114B, 116) is restricted along the expected threat direction 54, these parts 126 are able to move around the pulleys (114B, 116), consequently pulling the first and second ends (120A, 120B, 122A, 122B) away from the chassis 42 and floor 22, and therefore away from the passenger compartment 26.

Deformation of the chassis 42 can occur in a similar way to that described above with respect to FIGS. 1A and 1B.

The floor 22 is pulled downwards, or at least in a direction away from the passenger compartment 26 (not shown), and therefore is not projected into the passenger compartment 26.

It should be noted that this example demonstrated how an elongated element in the form of a cable can be used in a similar manner to the elongated element described above with respect to FIGS. 1A and 1B, and demonstrated that a system can also prevent a component, in this case the floor 22, from moving into the passenger compartment. It will be understood that a system in accordance with the subject matter of the present application can have any number of combinations of elongated elements. For example, one or more elongated elements, the one or more elongated elements being cables or beams etc. For example a system could include only one of the elongated elements (108, 110) described above, or that these elements could be constituted by a single elongated element joined along the intermediate portion thereof and having four ends.

While it has already been shown that a system in accordance with the subject matter of the present application can move an object away from a compartment to be protected, it should be noted that such system could also accomplish this by rotating an object.

Figure 3A:
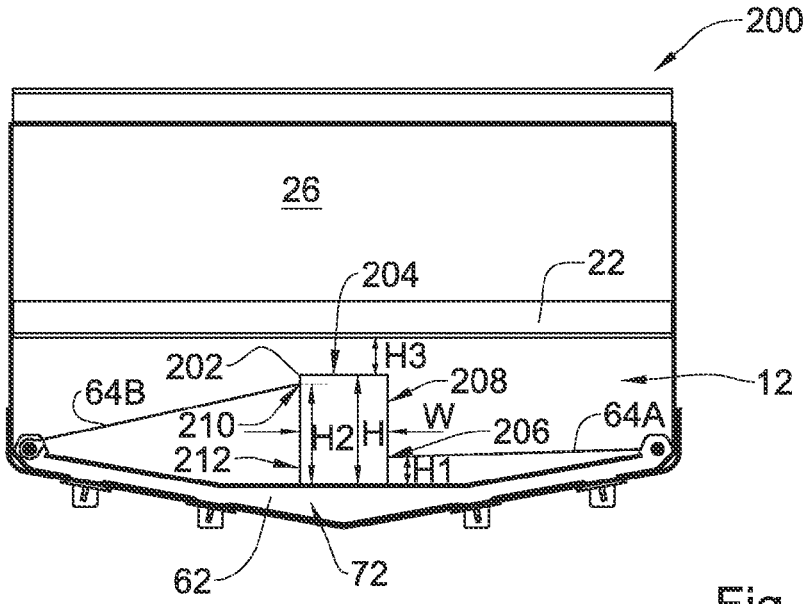
FIG. 3A is a schematic front view of a portion of a vehicle with yet another system therein for providing protection against an explosive threat.
Figure 3B:
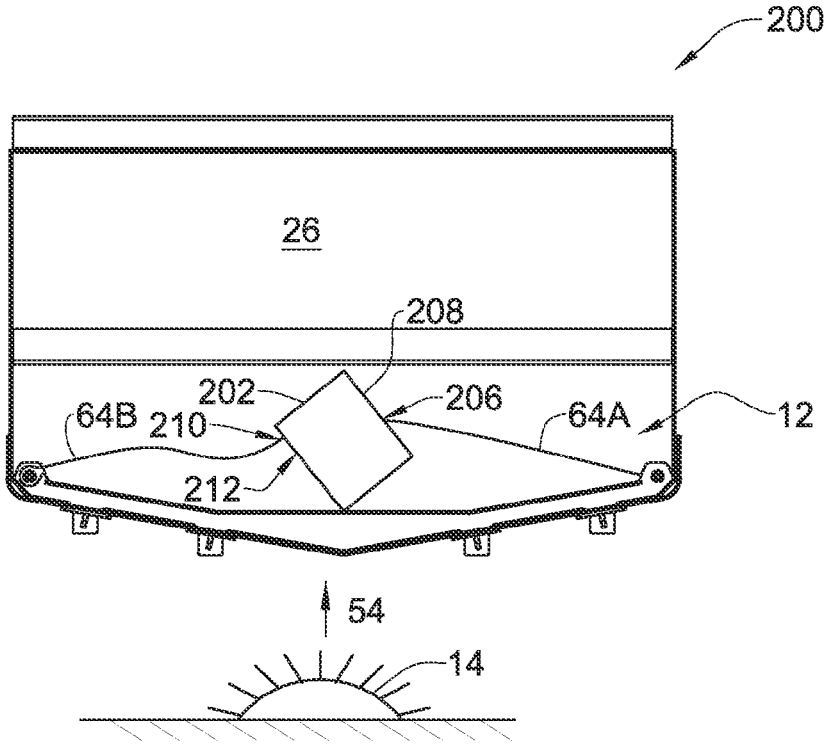
FIG. 3B is a schematic front view of the vehicle and system in FIG. 3A, illustrated in a position caused by an explosion.

For example, with reference to FIGS. 3A and 3B, there is shown vehicle 200 with a system 12, similar to that described above with respect to FIGS. 1A and 1B.

A difference being that the system 12 is not connected to a chassis but to a gearbox 202.

The gearbox 202 is disposed between the floor 22 and the bendable portion 72 of the elongated element 72.

The gearbox 202 has a height dimension H greater than a width dimension W thereof. Thus it would be preferable to rotate the gearbox 202 during an explosive event, rather than let a top portion 204 of the gearbox 202 move towards a passenger compartment 26 of the vehicle 200.

This is accomplished by connecting one of the ends 206 of one of the cables 64A to a first side 208 of the gearbox 202 at a height H1 from the bendable portion 72 of the elongated element 72, and connecting the other ends 210 of the other cables 64B to a second side 212 of the gearbox 202 at a height H2 from the bendable portion 72 of the elongated element 72. The heights H1 and H2 being of different magnitudes.

The difference in the position of the points of connection of the cables (64A, 64B) causing rotational movement of the gearbox 202, during an explosion, as seen in FIG. 3B.

Notably the gearbox 202 is spaced a distance H3 from the floor 22.

Figure 4:
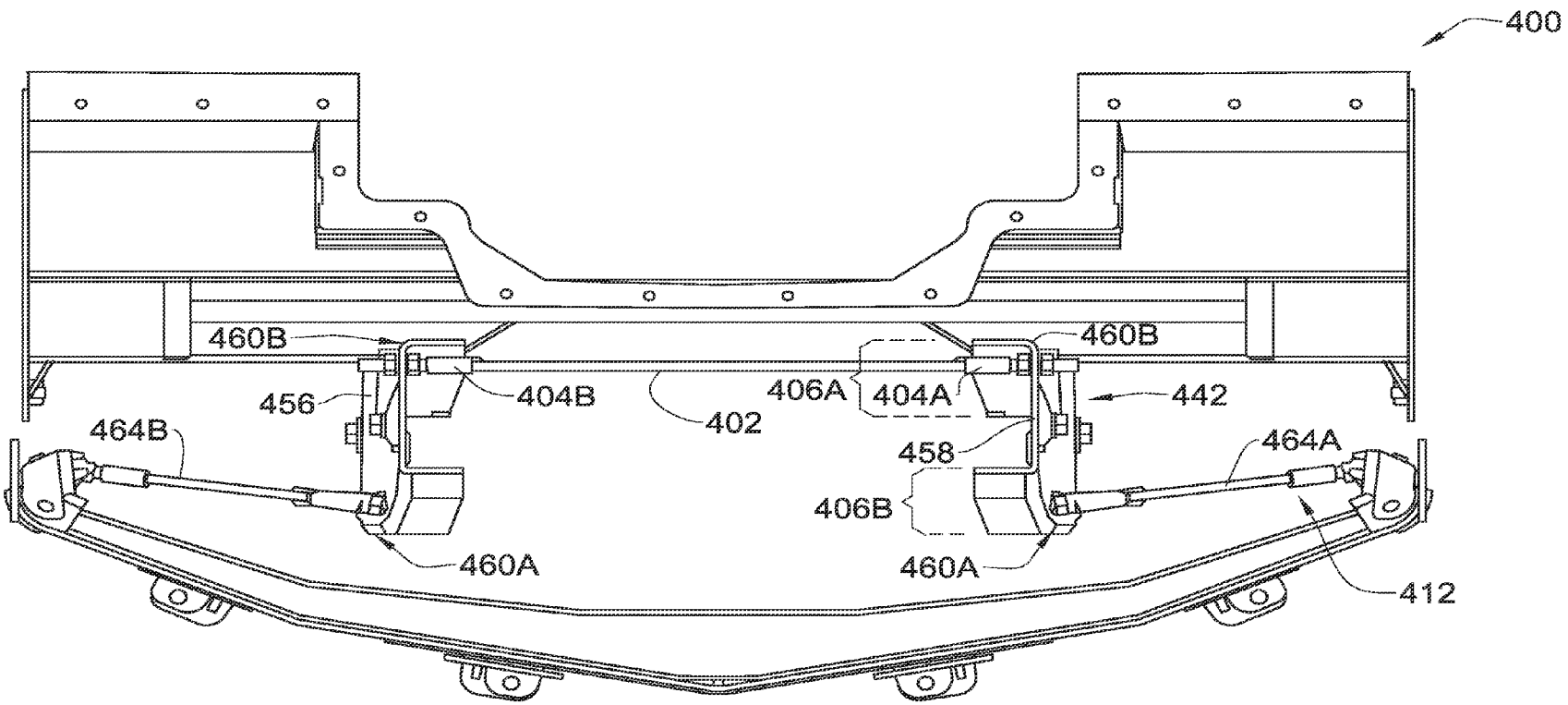
FIG. 4 is a schematic front view of a portion of a vehicle with still a further system therein for providing protection against an explosive threat.

Referring now to FIG. 4, it is shown that any of the systems in accordance with the subject matter of the present application can utilize elongated connection elements to allow a desired angle of the cables or to avoid potential obstacles in a path between the ends of the elongated element and component of the vehicle.

The vehicle 300 is shown with a system 302, which only differs from system 12 in that the connection elements (304A, 304B) on the chassis 42, are different to the connection elements (68A, 68B), and that the cables (64A, 64B) are connected to sides of the chassis which are distal to the respective end portion (70A, 70B) of the elongated element 62 to which they are connected.

The connection elements (304A, 304B) are in the form of elongated brackets having first and second ends (306A, 306B, 308A, 308B) spaced from each other. The first ends (306A, 306B) of the elongated brackets are mounted on the upper corners 60B of the chassis 42. The second ends (308A, 308B) are formed with apertures 310 which are spaced from and below the lower edge 60A of the chassis 42, and are used for connection with the cables (64A, 64B).

It will be understood that in order to control movement of a component to which the cables are connected or other components, additional elements can be added to the subject matter of the present application.

Figure 5:
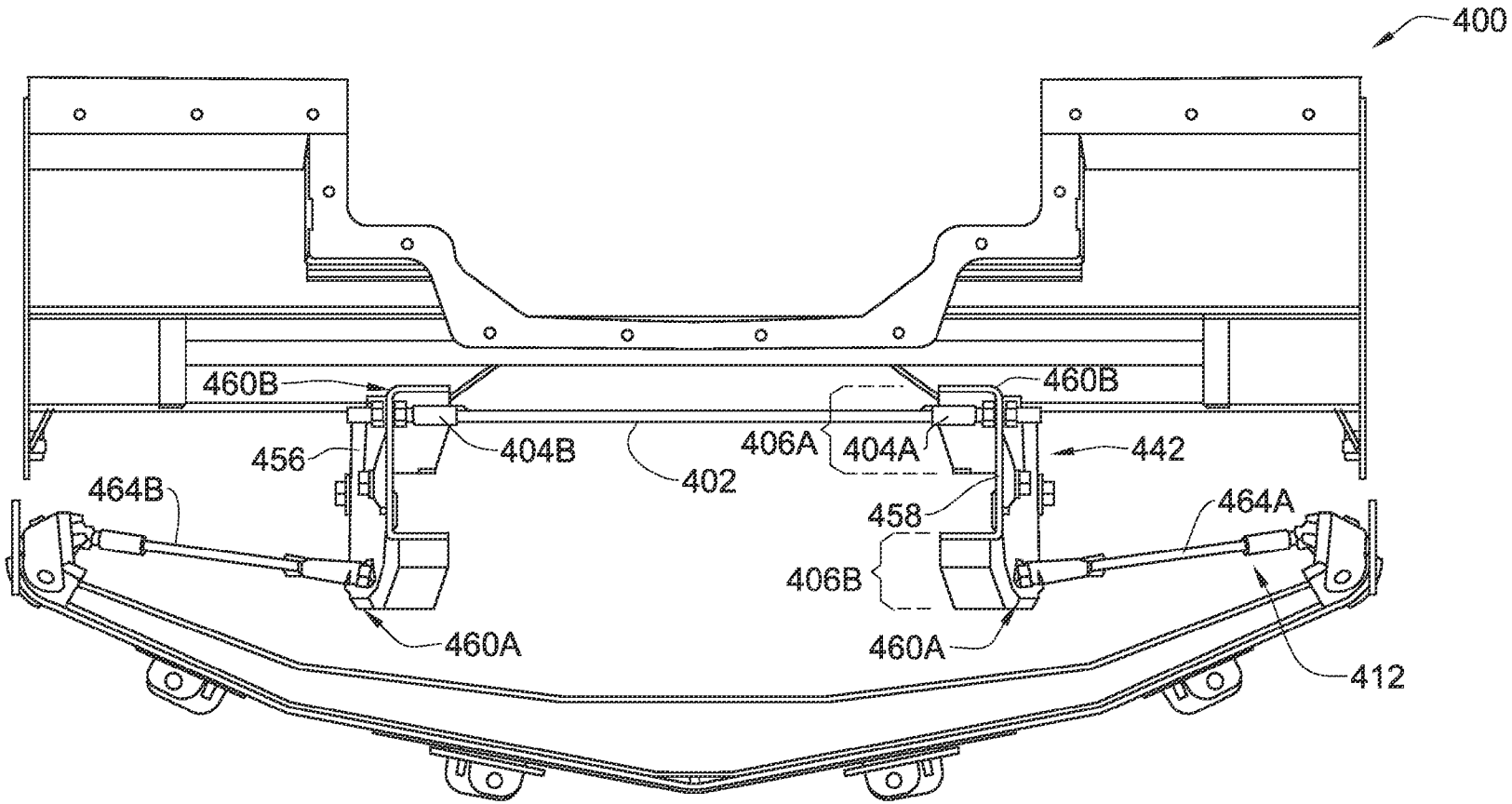
FIG. 5 is a schematic front view of a portion of a vehicle with still another system therein for providing protection against an explosive threat.

To elaborate, attention is drawn to FIG. 5. In FIG. 5 there is illustrated selected elements of a vehicle generally designated by the numeral 400, which in this example as an armored personnel carrier, and a system, generally designated as 412, disposed within the vehicle 400 for providing protection against an explosive threat (not shown) under the vehicle 400.

The vehicle 400 and system 412 is similar to that described with respect to FIG. 1 (i.e. vehicle 10 and system 12), with the following notable differences:

- the cables (464A,464B) are connected to the chassis 442, generally designated as 442, at lower corners 460A of longitudinal side beams 456 and 458 of the chassis 442;
- part of the transverse beams of the chassis 442 are hidden for the purposes of explanation; and
- the system 412 comprises a reinforcement element in the form of an additional cable 402 connected at a first end thereof 404A to an upper corner 460B of the longitudinal side beam 458 of the chassis 442, and a second end thereof 404B to an upper corner 460B of the longitudinal side beam 456 of the chassis 442.

During operation, the reinforcement element 402 serves to reduce or prevent deformation of the upper part 406A of the chassis 442 (i.e. at the height adjacent the upper corners 460B), in comparison with the lower part 406B of the chassis 442 (i.e. at the height adjacent the upper corners 460B). The reinforcement element 402 can serve to reduce upward motion of the chassis during an explosive event.

It will be understood that while the example reinforcement element given in the present example was a cable, a rigid element could also be used to provide such reinforcement function. It will be appreciated that the same function could be served by providing a chassis, even one without an additional reinforcement element, which is strengthened transversely between the upper sections of the longitudinal side beams thereof to a greater extent than transversely between the lower sections thereof. For example upper transverse beams of a chassis could merely be of greater thickness (and/or made of stronger material) than the lower transverse beams thereof.

As in the previous examples, there could be a plurality of systems 412, in the length of the vehicle.

Figure 6A:
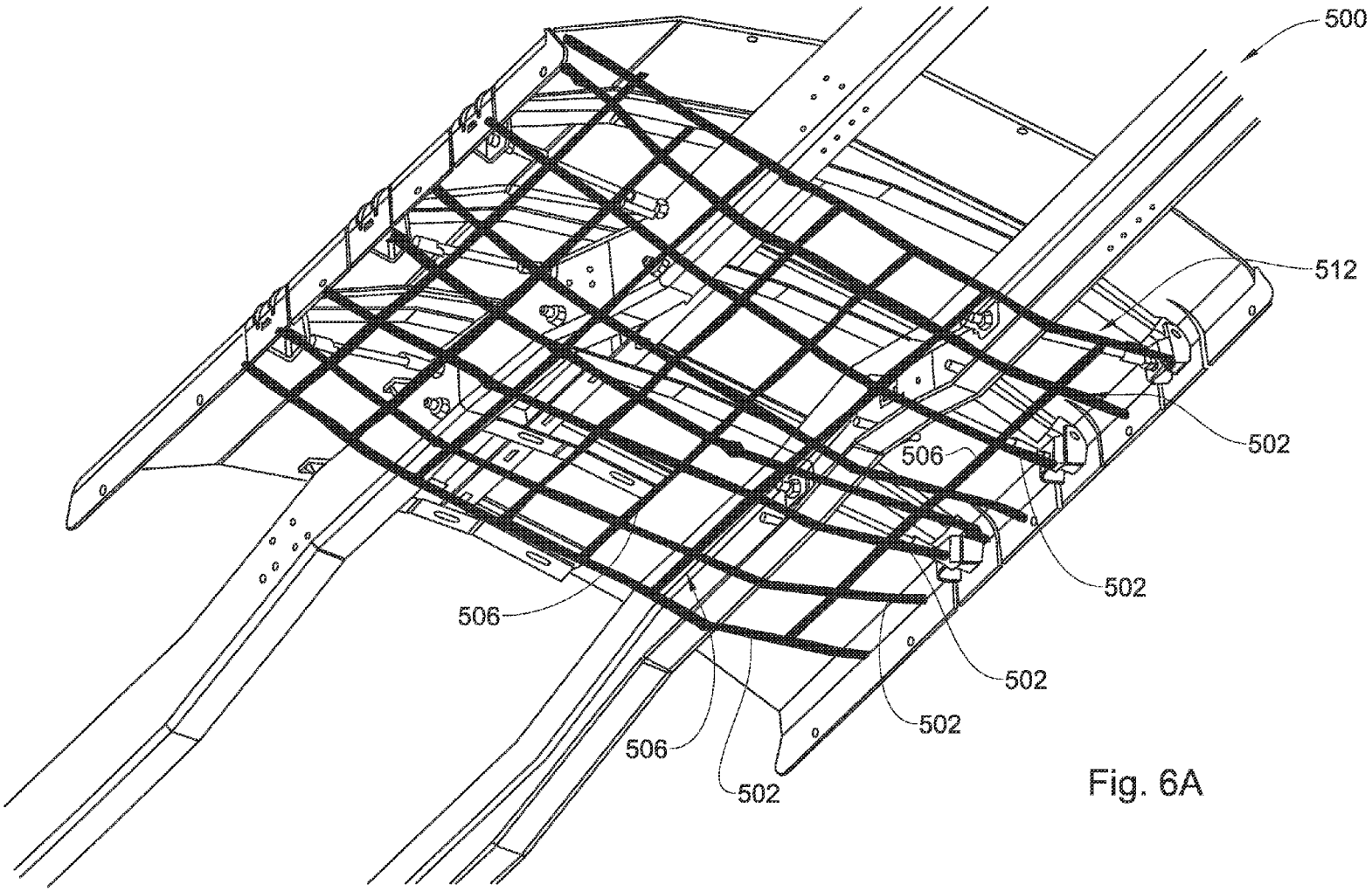
FIG. 6A is a schematic perspective view of a portion of a vehicle with yet another system therein for providing protection against an explosive threat.
Figure 6B:
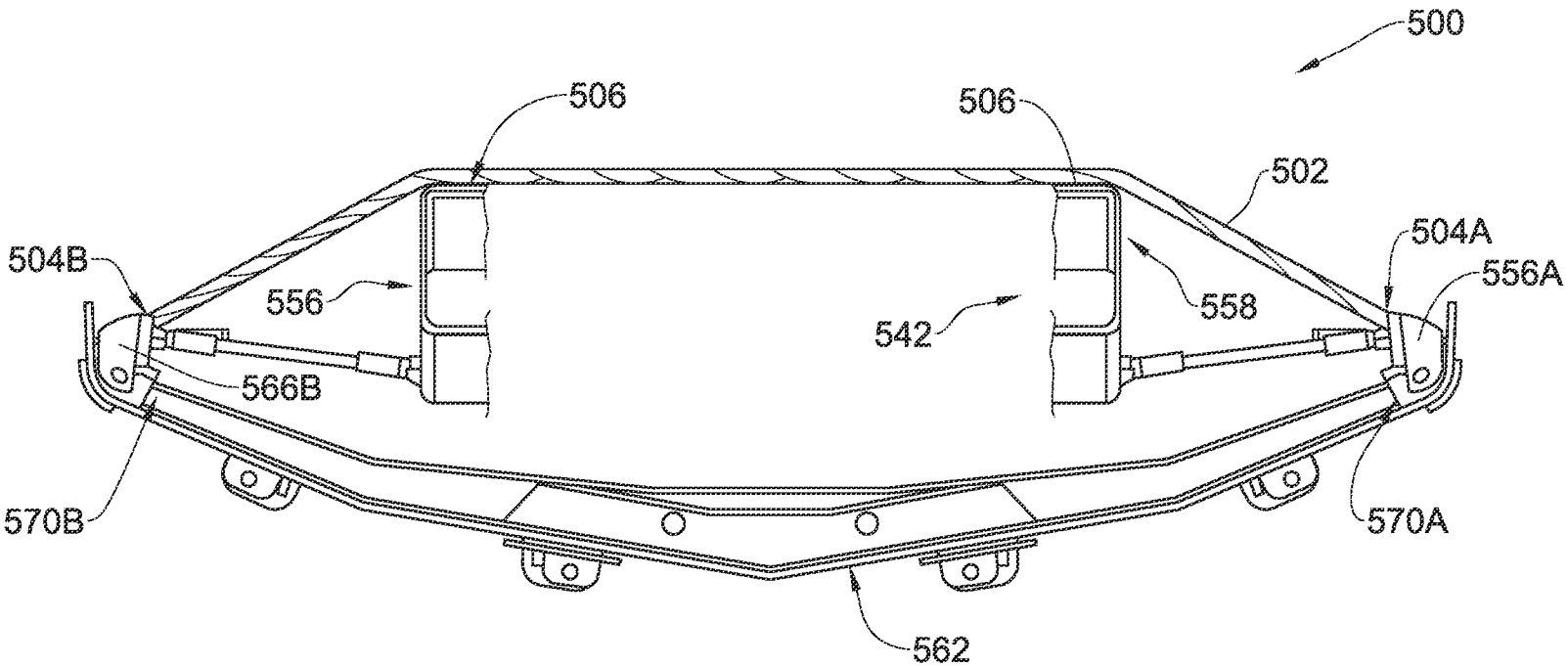
FIG. 6B is a schematic front view of the vehicle and system in FIG. 6A, illustrated in a position caused by an explosion.

An alternative system, generally designated as 512, is illustrated in FIGS. 6A and 6B.

The alternative system 512 is similar to that described with respect to FIG. 5 (i.e. vehicle 400 and system 412), with the following notable differences:

- there is no reinforcement element 402, but rather an additional cable 502, connected at each end thereof (504A, 504B) to one of the ends (570A, 570B) of the elongated element 562 via connection elements (566A, 566B) thereof; the additional cable 502 engaging the upper surfaces 506 of the longitudinal side beams (556,558) of the chassis 542.
- there are a plurality of systems 512 shown (FIG. 6A) and the plurality of systems 512 comprise another plurality of cables 506 extending in a direction transverse to each additional cable 502.

As will be understood, the additional cable 502 serves to restrict upward motion of the longitudinal beams (556, 558) during an explosive event (not shown) underneath the vehicle 500.

In the present example, there is shown a plurality of additional cables 502 which extend transversely along the vehicle, and the other plurality of cables 506 extend longitudinally along the vehicle. It will be appreciated, that, while the additional cables 502 serve to restrict upward motion of the longitudinal beams (556, 558), the addition of a further plurality of cables, contribute by creating a net configuration together with the additional cables 502. The net configuration is configured to catch or restrict upward motion of other components (not shown) of the vehicle, which are disposed thereunder, during an explosive event (not shown).

In the present example, the additional cables and transverse cables (502,506) are secured to each other at each junction thereof. However such connection is not essential, and the additional cables and transverse cables (502,506) can be arranged in the net configuration in any desired manner (e.g. touching but not secured to each other, secured to each other at only selected junctions thereof, integrally formed with each other so that both plurality of cables can be considered a single element).

Figure 7:
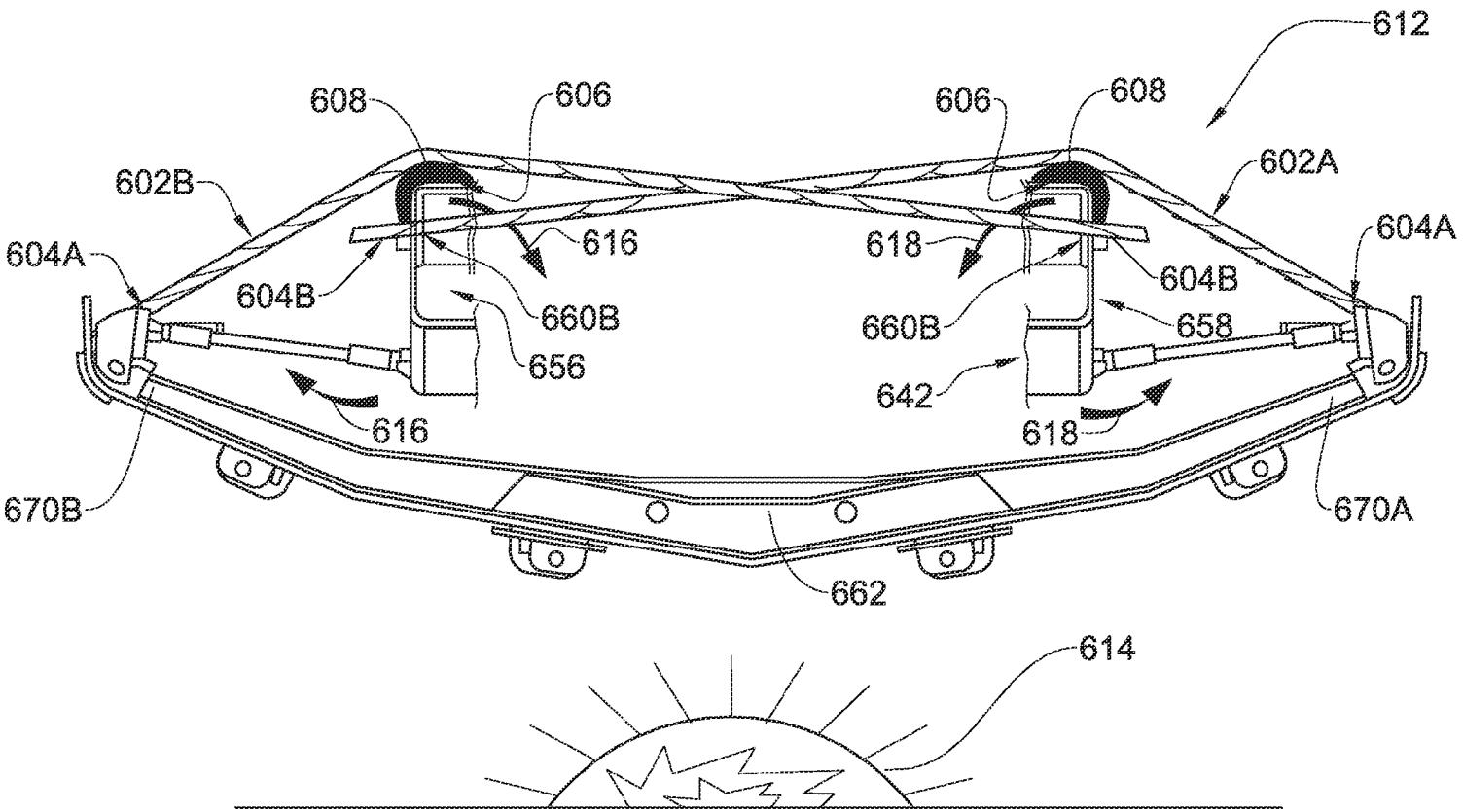
FIG. 7 is a schematic front view of a portion of a vehicle with still another system therein for providing protection against an explosive threat, as well as an explosion shown thereunder.

Yet another system, generally designated as 612, is illustrated in FIG. 7.

The system 612 is similar to that described with respect to FIGS. 6A and 6B (i.e. vehicle 500 and system 512), with the following notable difference:

- Instead of comprising an additional cable 502 connected at both ends thereof to the elongated element 562, there are two additional cables (602A,602B), each additional cable (602A,602B) of the present example, is connected at a first end thereof 604A to one of the ends (670A, 670B) of the elongated element 662, and at a second end thereof (604B) to an upper corner 660B of the longitudinal side beam (656,658) of the chassis 642;
- the system 612, further comprises protective elements 608 disposed between the upper surfaces 606 of the longitudinal side beams (656,658) of the chassis 642 and the additional cables (602A,602B) to prevent sharp corners of the chassis from damaging the cables (602A,602B).

During an explosion 614, each of the longitudinal side beams (656,658) can turn in the directions shown by arrows (616, 618), respectively.

Notably, the system 612 can provide a type of reinforcing effect, described in connection with the system 412, as well as a downward arresting motion of the chassis 642, (and other components when a net-configuration is utilized) similar to that described in connection with FIGS. 6A and 6B.

Figure 8:
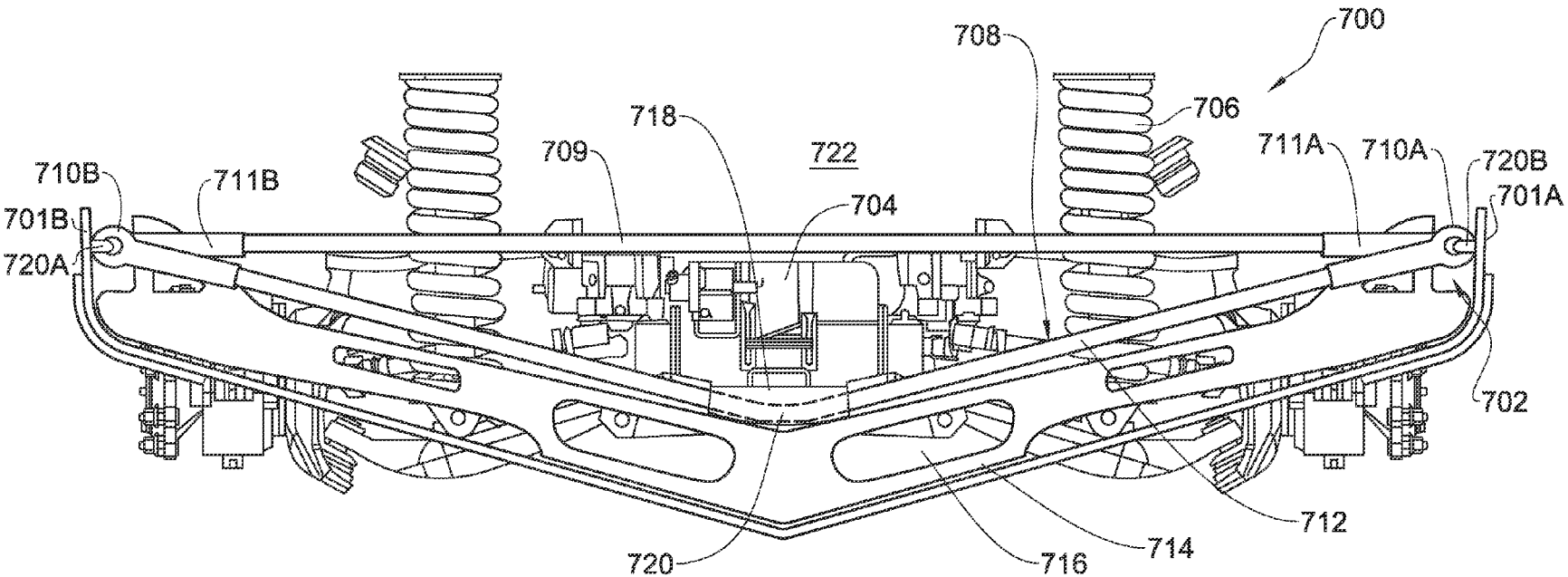
FIG. 8 is a schematic front view of a portion of a vehicle with still another system therein for providing protection against an explosive threat.

Referring now to FIG. 8, there is illustrated selected elements of a vehicle generally designated by the numeral 700, and a system, generally designated as 702, disposed within the vehicle 700 for providing protection against an explosive threat (not shown) disposed on the ground (not shown) under the vehicle 700.

The vehicle 700 comprises the same elements as those described above with respect to FIGS. 1A and 1B, such as side walls (701A, 701B). Example internal elements of the vehicle such as the transmission 704 and suspension system 706 are shown.

The system 102 comprises an elongated element 708, which is a continuous cable of the same type as the cables (108, 110) described above with reference to FIG. 2, and is held in a taut state, and a component, which in this case is an additional elongated element 709.

The elongated element 708 is similar to elongated elements (108, 110), in that it is a continuous cable having first and second ends (710A, 710B) and a bendable portion 712 extending therebetween. Each of the ends of which (710A, 710B) is in the shape of a loop.

The system 702 further comprises a V-shaped beam 714, formed with slots 716 to reduce the weight thereof, and a sleeve-shaped connection element 718 secured to the V-shaped beam 714, which receives a middle portion 720of the elongated element 708 therethrough, thereby holding the element 708 adjacent the beam 714 in a spatial position closely corresponding to the shape of the beam 714 (which in this example is V-shaped). The elongated element 708 is connected in a dynamic manner to the sleeve-shaped connection element 718.

The elongated element 709 is a cable of similar construction to the elongated element 708, except that it has a shorter length and extends horizontally between the side walls (701A, 701B).

Other differences between the system shown in FIG. 2 and that shown in FIG. 8 are that:

- the first and second ends (710A, 710B) of the elongated element 708 are connected in a static manner to connection elements (720A, 720B) which are attached to the side walls (701A, 701B).

ends (711A, 711B) of the component 709 are connected to the elongated element 708 via them both being attached common connection elements (720A, 720B).

In operation, the elongated element 708 behaves in the same manner as that described above with respect to cables (108, 110), and the first and second ends (710A, 710B) thereof pull the ends (711A, 711B) of the component 709 upon detonation of an explosive threat underneath the vehicle.

However in this example, the tensile strength of the cable 709 causes motion of the side walls (710A,701B) to be restricted. This can cause strengthening the vehicle's structure, thereby reducing inward bending movement of the V-shaped beam 714, and reducing motion of the internal elements of the vehicle 700 and cable 709 from movement towards the compartment 722 to be protected.

Stated differently, the component in this case, diverts forces of an explosion to a weaker part of the construction, which in turns reduces movement into a compartment to be protected.

Figure 9:
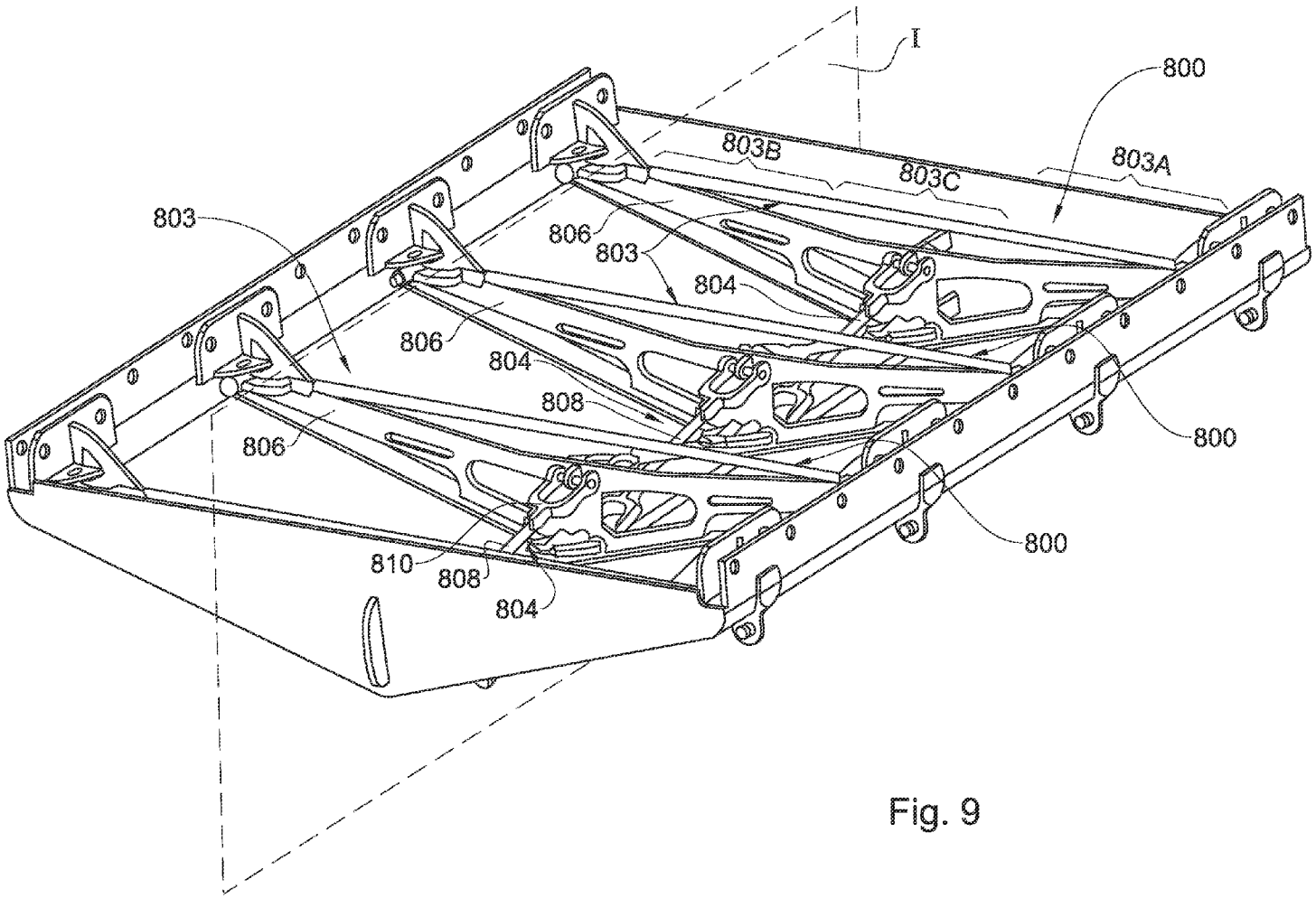
FIG. 9 is a schematic perspective view of a portion of a vehicle with yet other systems therein for providing protection against an explosive threat.

With reference to FIG. 9, a further example of systems 800 are shown, which are similar to system 700, in that the component 802 is a horizontal cable 803.

Each system 800 further comprises reinforcement elements 804 extending between each other.

Each reinforcement elements 804 comprises an elongated rigid steel rod 808 having a connection bracket 810 secured to each end thereof and which in turn is secured to one of the horizontal beams 806.

Between each pair of adjacent horizontal beams 806, there are two reinforcement elements 804 which form an X-shaped configuration (when viewed from the side). The elements 804 extend in a direction which is parallel with a vertical longitudinal plane I of the vehicle.

It will be understood that the elements can extend in other directions, and could also be connected to another element of a system or a portion of a construction, for example, such as a side wall of the vehicle.

It is noted that in each system 800 the present example, the elongated element is constituted by the horizontal beam 806, and the two cables are outer portions (803A,803B) of the cable 803, the component 803C being constituted by a central portion of the cable 803.

In operation, the elongated element 806, and two cables (803A,803B), can behave in a manner corresponding to that described above with respect to system 12 in FIG. 1 (in particular elongated element 62 and cables (64A, 64B)), and the component 803C behaves in a manner corresponding to that described above with respect to system 700 in FIG. 8.

Additionally, the reinforcement elements 804 further reduce upward motion of the components 803 or other elements adjacent to the vehicle belly by reducing upward motion of the elongated elements to which they are connected.

It will be understood that an explosion may be located under one or some of the systems 800, and therefore other systems may be less affected than those closer to such explosion. Accordingly the reinforcement elements 804 may assist the other systems 800, and in particular the elongated elements 803 to which the reinforcement elements are connected (in this case the horizontal beams) to undergo twisting or bending motion rather than upward translational movement.

Figure 10:
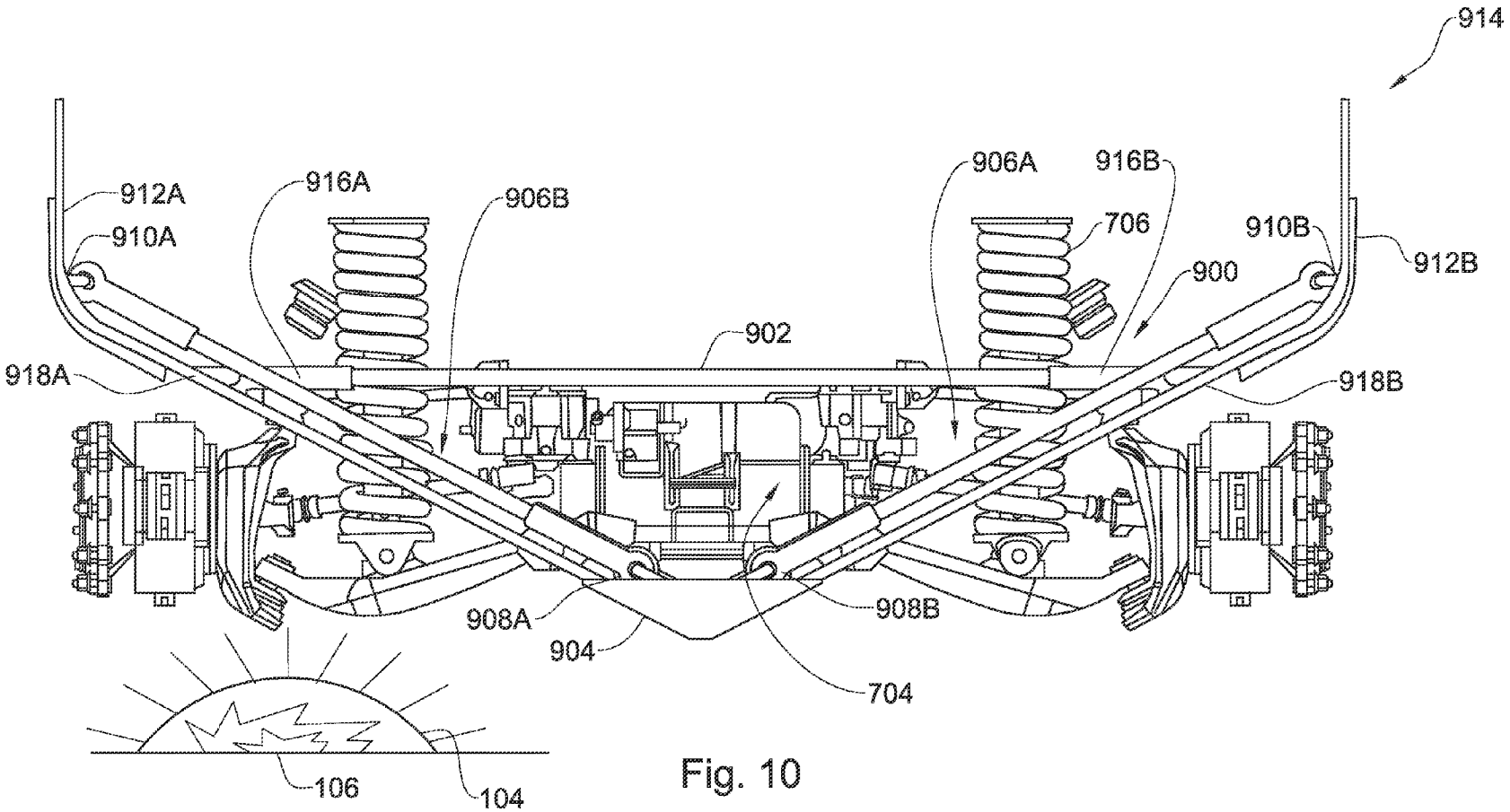
FIG. 10 is a schematic front view of a portion of a vehicle with another system therein for providing protection against an explosive threat.

Referring to FIG. 10, there is shown yet another example system 900 which is similar to the systems (700,800) in that the component 902 is a horizontal cable.

The system 900 differs primarily from the system 700 shown in FIG. 8, in that:

it does not comprise a single continuous cable 708, but rather comprises an elongated element 904, two cables (906A, 906B), and connection elements (908A, 908B, 910A, 910B) for connection of the elongated element 904, two cables (906A, 906B) and side walls (912A, 912B) of the vehicle 914; and first and second ends (916A, 916B) of the component 902 are connected to the elongated element 708 via them both being attached to a common portion of the construction (i.e. the side walls (912A, 912B) of the vehicle 914).

To elaborate, the first and second ends (916A, 916B) of the component 902 are connected to connection elements (918A, 918B) which are secured to the side walls (912A,912B) of the vehicle 914, at portions of the side walls (912A,912B) adjacent to where the connection elements (910A, 910B) are disposed.

In operation, the elongated element 904, and two cables (906A, 906B), can behave in a manner corresponding to that described above with respect to system 12 in FIG. 1 (in particular elongated element 62 and cables (64A, 64B)), and the component 902 behaves in a manner corresponding to that described above with respect to system 700 in FIG. 8.

However, it will be understood that depending on the position of the detonation with respect to the vehicle, the elongated element 62 may not bend, but one of the cables (906A, 906B) may bend similar to that described and shown with respect to FIG. 2.

In any case, it will be understood that the cables (902, 906A, 906B) can be connected to adjacent portions of a common object (which in this case is side walls (912A, 912B) of the vehicle 914) and the system will still behave in a similar manner to that described above with respect to FIG. 8.

The invention claimed is:

1. A system for use in a construction having a compartment to be protected from an explosive threat incoming from an expected threat direction, the compartment including peripheral portions, a surface having respective ends coupled to the peripheral portions of the compartment and disposed in front of the compartment relative to the threat direction and being spaced therefrom, the surface having at least a section thereof expected to be impacted by the explosive threat, and a component associated with the compartment and disposed between the surface and the compartment, the system comprising:

an elongated element having two end portions and a bendable portion, the elongated element being configured for mounting in said construction so as to be at least indirectly fixedly attached to the surface at or near the respective ends of the surface that are coupled to the peripheral portions of the compartment and so that at least a part of said bendable portion is disposed between said section and said compartment and is configured to flex towards the compartment to be protected, upon application thereto of a force caused by the explosive threat; and two cables, each cable being connectable at one end thereof to the component, and at the other end thereof being connected to one of the ends of the elongated element so that flexing of the bendable portion towards the component causes pulling of the cables by the ends of the elongated element away from the component, thereby restricting the movement of the component towards the compartment to be protected.

2. The system of claim 1, wherein the elongated element is a cable and the elongated element and the two cables together constitute portions of a single continuous cable.

3. The system of claim 1, wherein the elongated element is a beam.

4. The system of claim 1, wherein the construction is a vehicle.

5. The system of claim 1, wherein the component has a first dimension of length and a second dimension of length smaller than, and transverse to, the first dimension; the first dimension being the largest length of the component along an imaginary axis extending through the component from the section of the surface to the compartment to be protected; the ends of the cables being configured to be connectable to the component at connection points which are each adjacent to axis points of the imaginary axis that are spaced from each other, so that the pulling of the cables causes rotation of the component.

6. The system of claim 1, wherein the construction is a vehicle and the component is a chassis of the vehicle.

7. The system of claim 1, further comprising at least one elongated bracket having first and second ends spaced from each other; the first end of the at least one elongated bracket being configured to be mounted on the component; at least one of the two cables being configured to be connectable to the component via connection with the second end of the at least one elongated bracket.

8. The system of claim 1, wherein the two end portions of the elongated element are configured to move in a direction away from the compartment to be protected, upon the application to the elongated element of the force caused by the explosive threat.

9. The system of claim 8, wherein the two end portions of the elongated element are configured to move in a direction away from the compartment to be protected by engagement with vertical walls of the construction.

10. The system of claim 1, wherein the system is part of an assembly including at least two such systems.

11. The system of claim 1, wherein the two cables are configured to be connected to the component in a normally taut state.

12. The system of claim 1, further comprising at least one additional cable for restricting upward motion of the component.

13. The system of claim 12, wherein the at least one additional cable engages an upper portion of the component.

14. The system of claim 12, wherein the component is a chassis and at least one additional cable is connected between two longitudinal beams of the chassis.

15. The system of claim 12, wherein the at least one additional cable is two cables, each connected at a first end thereof to one of the ends of the elongated element, and at a second end thereof to an one side of the component.

16. The system of claim 12, wherein the at least one additional cable is a plurality of cables which together form a net configuration.

17. The system of claim 1, wherein the component is reinforced at an upper section thereof in comparison to a lower section thereof to which the cables are connected.

18. The system of claim 1, being a part of an assembly comprising at least two such systems, the assembly further comprising at least one reinforcement element connected between adjacent systems for providing reinforcement thereto.

19. The system of claim 1, wherein the component is a cable.

20. The system of claim 1, wherein the component is an intermediary portion of a cable, the cable including said two cables each of which constitute a portion of the cable extending from alternative sides of the intermediary portion.

* * * * *